US009845607B2

(12) United States Patent
Spicer

(10) Patent No.: US 9,845,607 B2
(45) **Date of Patent: *Dec. 19, 2017**

(54) COVER ASSEMBLY FOR A SPA

(71) Applicant: STRONG INDUSTRIES, INC., Northumberland, PA (US)

(72) Inventor: Wade Spicer, Northumberland, PA (US)

(73) Assignee: STRONG INDUSTRIES, INC., Northumberland, PA (US)

( * ) Notice: Subject to any disclaimer, the term of this patent is extended or adjusted under 35 U.S.C. 154(b) by 23 days.

This patent is subject to a terminal disclaimer.

(21) Appl. No.: 14/862,329

(22) Filed: Sep. 23, 2015

(65) Prior Publication Data

US 2016/0010351 A1 Jan. 14, 2016

Related U.S. Application Data

(63) Continuation of application No. 13/661,537, filed on Oct. 26, 2012, now Pat. No. 9,181,721.

(60) Provisional application No. 61/553,665, filed on Oct. 31, 2011.

(51) Int. Cl.

| | |
|---|---|
| ***E04H 4/00*** | (2006.01) |
| ***E04H 4/08*** | (2006.01) |
| ***E04H 4/14*** | (2006.01) |
| ***A61H 33/00*** | (2006.01) |
| *A61H 33/02* | (2006.01) |

(52) U.S. Cl.

CPC ..... *E04H 4/084* (2013.01); *A61H 33/0087* (2013.01); *A61H 33/6005* (2013.01); *E04H 4/14* (2013.01); *A61H 33/02* (2013.01)

(58) Field of Classification Search

CPC ..... E04H 4/084

USPC ..... 4/498, 592

See application file for complete search history.

(56) References Cited

U.S. PATENT DOCUMENTS

| | | | | |
|---|---|---|---|---|
| 4,742,598 | A | 5/1988 | Bruneau | |
| 4,853,985 | A * | 8/1989 | Perry | B65F 1/1623 16/287 |
| 5,950,252 | A * | 9/1999 | Fettes | E04H 4/084 4/498 |
| 5,974,600 | A * | 11/1999 | Pucci | E04H 4/084 4/498 |
| 6,000,071 | A | 12/1999 | Fettes | |
| 6,032,305 | A | 3/2000 | Tedrick | |
| 6,718,566 | B1 | 4/2004 | Wilson | |
| 6,795,984 | B1 * | 9/2004 | Brady | E04H 4/084 220/263 |
| 7,752,685 | B2 * | 7/2010 | Tudor | E04H 4/084 4/498 |

(Continued)

*Primary Examiner* — Christine Skubinna

(74) *Attorney, Agent, or Firm* — Grogan, Tuccillo & Vanderleeden, LLP

(57) ABSTRACT

A lift assembly for a spa cover includes a lifting arm having a first end pivotally connectable to the spa cover and a second end pivotally connectable to a base of a spa, the connection of the second end of the lifting arm with the spa housing defining a pivot point, and a lift-assist device having a first end configured for coupling to the base at a point substantially directly below the pivot point and a second end operatively connectable to the lifting arm. The lift-assist device is configured to exert a generally upwards biasing force on the cover when the cover is received atop said spa.

15 Claims, 12 Drawing Sheets

(56) References Cited

U.S. PATENT DOCUMENTS

| | | | | |
|---|---|---|---|---|
| 7,784,120 | B2 * | 8/2010 | Spicer | A61H 33/0087 4/541.1 |
| 2006/0107454 | A1 | 5/2006 | Spicer | |
| 2007/0017016 | A1 | 1/2007 | Piche et al. | |
| 2007/0209104 | A1 | 9/2007 | Buzzetti et al. | |
| 2008/0244820 | A1 | 10/2008 | Moore | |

* cited by examiner

COVER ASSEMBLY FOR A SPA

CROSS-REFERENCE TO RELATED APPLICATIONS

This application is a continuation of U.S. patent Ser. No. 13/661,537, entitled "SPA HAVING A VERTICALLY ACTUATABLE COVER ASSEMBLY," filed on Oct. 26, 2012, which claims the benefit of U.S. Provisional Application Ser. No. 61/553,665, filed on Oct. 31, 2011, both of which are herein incorporated by reference in their entireties.

FIELD OF THE INVENTION

The present invention relates generally to spas and, more particularly, to a sub-frameless spa having a vertically actuatable cover assembly and support structure for the same.

BACKGROUND OF THE INVENTION

The construction of spas is well known in the art. Typically, a spa is created by forming a wooden sub-frame made out of wood two-by-fours (or possibly a metal support frame or truss members) with an exterior wooden wanes coating or the like attached as an outer surface. Alternatively, a sub-frame made with two-by-fours or the like can be created which is coated on the outside with a form of plastic single wall panels. The wooden support frame typically then receives a formed acrylic or other type of plastic spa shell, as is well known in the art.

Existing sub-frame type spas may also include covers for preventing contamination due to environmental debris, such as leaves, pollen and the like, to prevent excess evaporation when the spa is not in use, and to act as a safety measure to prevent animals and children from falling into the water. Conventional spa covers may be fabric covered foam structures which rest atop the spa and are slid off the spa or are folded up when the spa is in use, or can be vertically movable covers that prevent contamination when resting atop the spa in a lowered position, and as a roof when in a raised position. U.S. Pat. No. 6,718,566 to Wilson and U.S. Pat. Nos. 7,600,271 and 7,614,093 to Piche et al. disclose various vertically movable covers for sub-frame type spas and lifting mechanisms therefor.

Notably, improvements in spa design and construction have eliminated the need to utilize wooden or any other type of sub-frame as a spa support structure. For example, U.S. Pat. No. 7,784,120 discloses a sub-frameless support structure for a spa that provides for cost savings, added strength and efficiency as compared to sub-frame type spas. Existing vertically movable covers, while being generally suitable for use with spas having a wooden or other sub-frame, are not readily adaptable to spas that are devoid of a sub-frame support structure.

In view of the above, there remains a need for a robust spa support structure that is capable of supporting a vertically movable cover assembly without the need for a sub-frame. There is also a need for a spa assembly having a vertically extendable cover assembly that allows access to components of the cover assembly within the support structure without removal of the spa shell or deconstruction of the spa support structure.

SUMMARY OF THE INVENTION

It is an object of the present invention to provide a sub-frameless spa having a vertically actuatable cover assembly.

It is another object of the present invention to provide a sub-frameless spa having a support structure for a vertically actuatable cover assembly.

It is another object of the present invention to provide a sub-frameless spa having a support structure for a vertically actuatable cover assembly that allows for easy access to components of the cover assembly within the support structure.

A spa according to the present invention includes a shell and a support structure including a base member, a plurality of side members and a plurality of end members to support the shell without the need for a sub-frame. The spa also includes a cover and a plurality of lifting members for supporting the cover. The lifting members are actuatable between a lowered position in which the cover is positioned generally atop the shell and an elevated position in which the cover is spaced from the shell and the support structure. The lifting members are secured to at least one of the side members and the end members.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
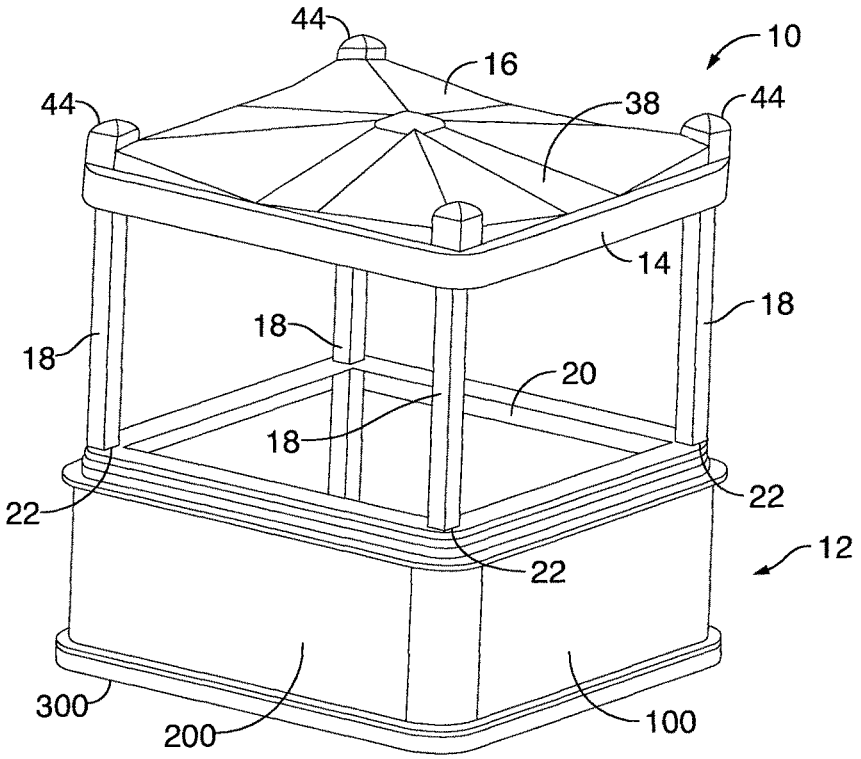
FIG. 1 is a perspective top view of spa having a vertically actuatable cover assembly according to an embodiment of the present invention.
Figure 2:
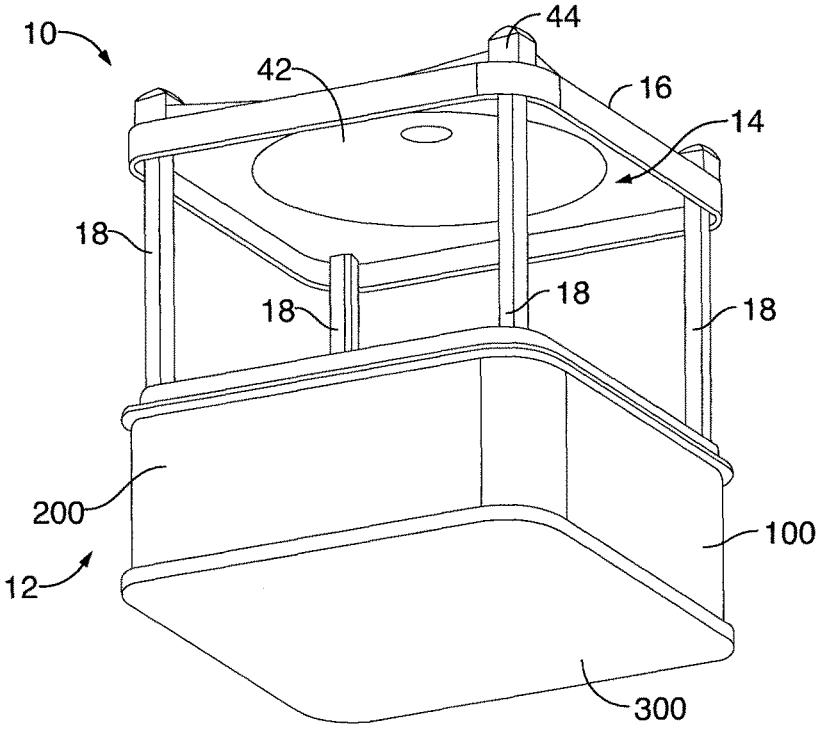
FIG. 2 is a perspective bottom view of the spa of FIG. 1, illustrating the cover assembly in a raised position.
Figure 3:
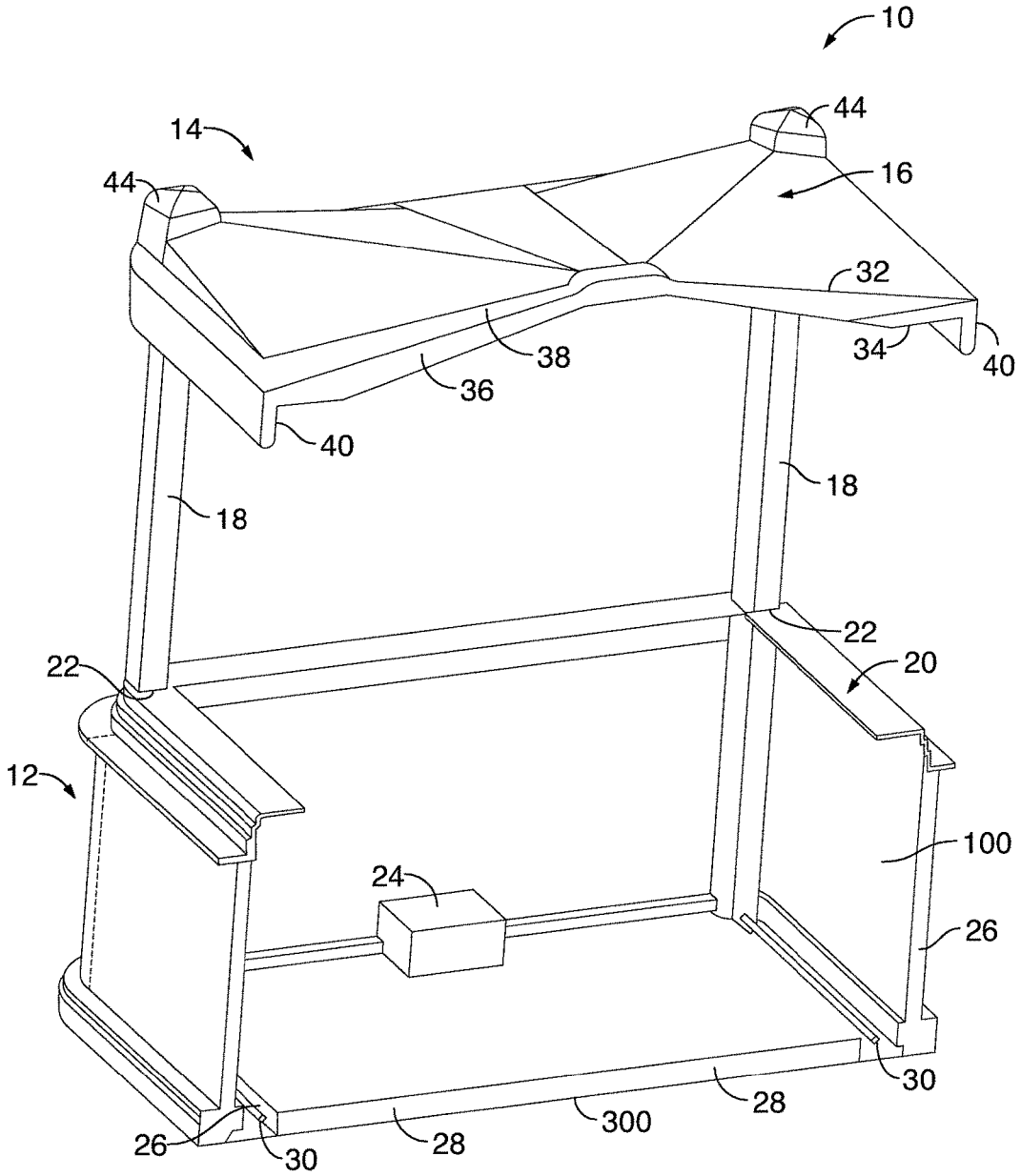
FIG. 3 is a cross-sectional, perspective view of the spa of FIG. 1, illustrating a cover assembly lifting mechanism.
Figure 4:
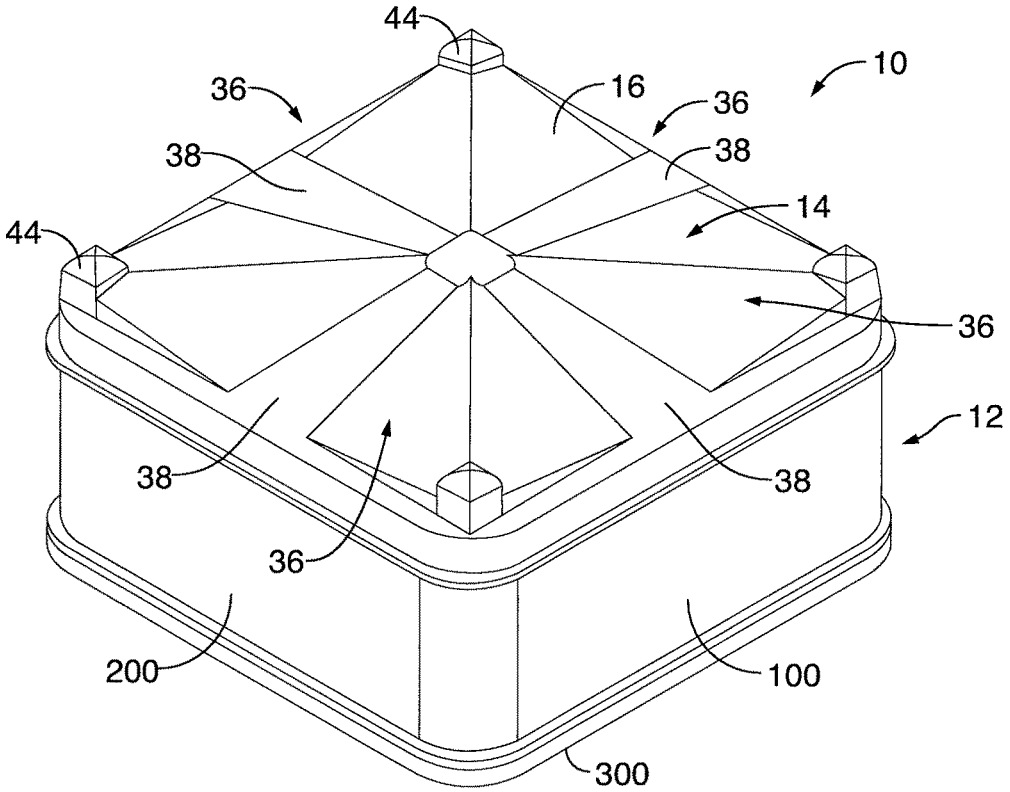
FIG. 4 is a perspective top view of the spa of FIG. 1, showing the cover assembly in a lowered position.
Figure 5:
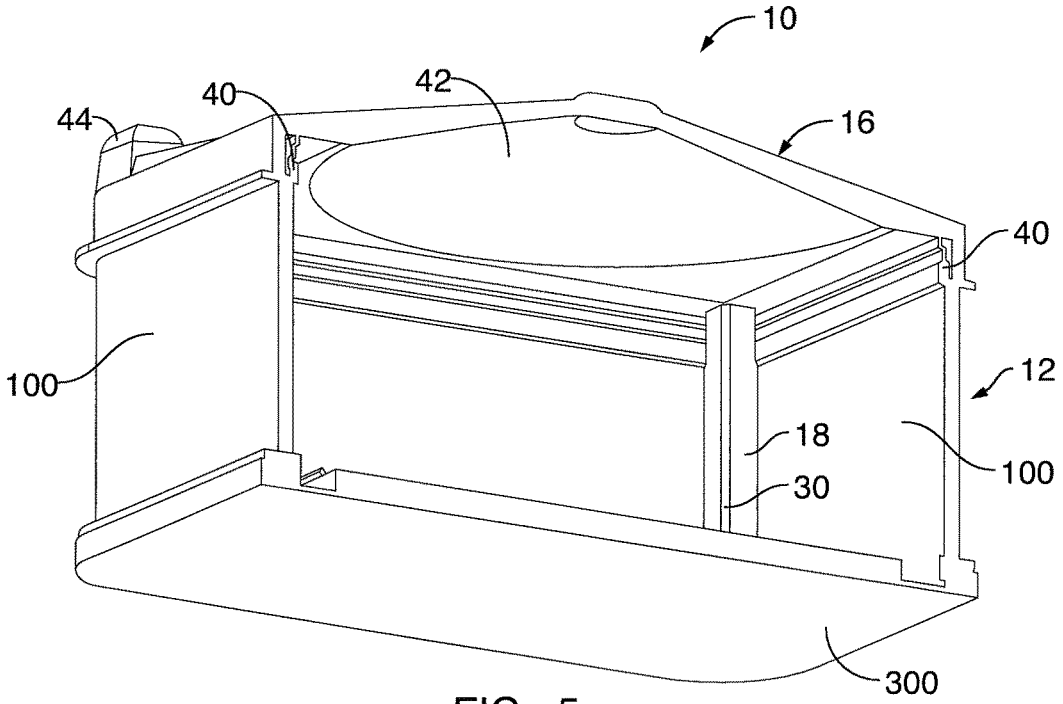
FIG. 5 is a cross-sectional perspective view of the spa of FIG. 1, with the cover assembly in a lowered position.

Referring to FIGS. 1-5, a spa 10 having a vertically actuatable cover assembly according to an embodiment of the present invention is shown. As shown therein, the spa 10 includes a spa cabinet 12 and a cover assembly 14. The cover assembly 14 includes a cover 16 supported on lifter arms 18, positioned at each corner of the spa 10. The lifter arms 18 elevate the cover 16 from a lowered position, as shown in FIG. 5, wherein the cover 16 rests atop of or adjacent to a top edge of the spa 10, to a raised position, as shown in FIGS. 1 and 2, wherein the cover 16 is supported in an elevated position over the spa cabinet 12, in the manner discussed hereinafter.

Figure 6:
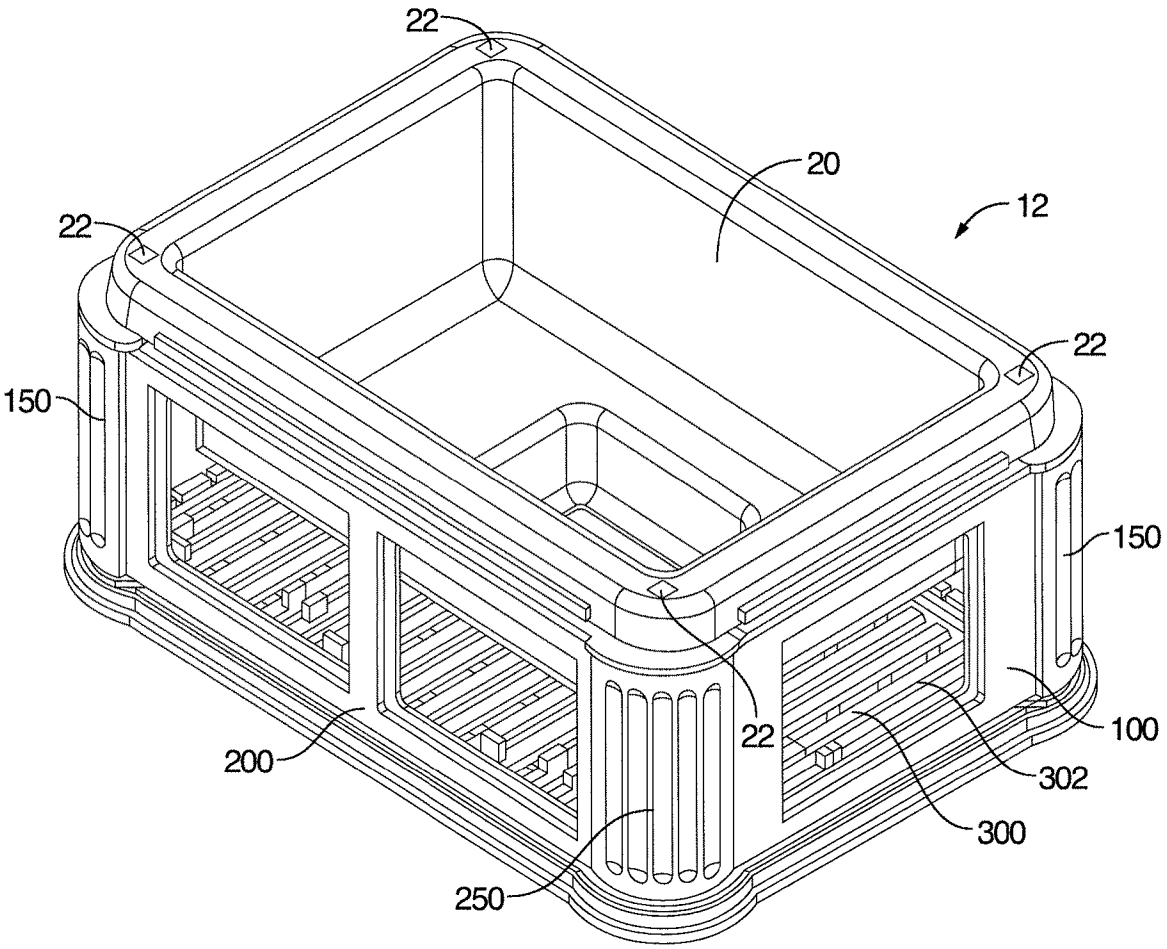
FIG. 6 is a perspective view of the sub-frameless support structure of the spa of FIG. 1.
Figure 7:
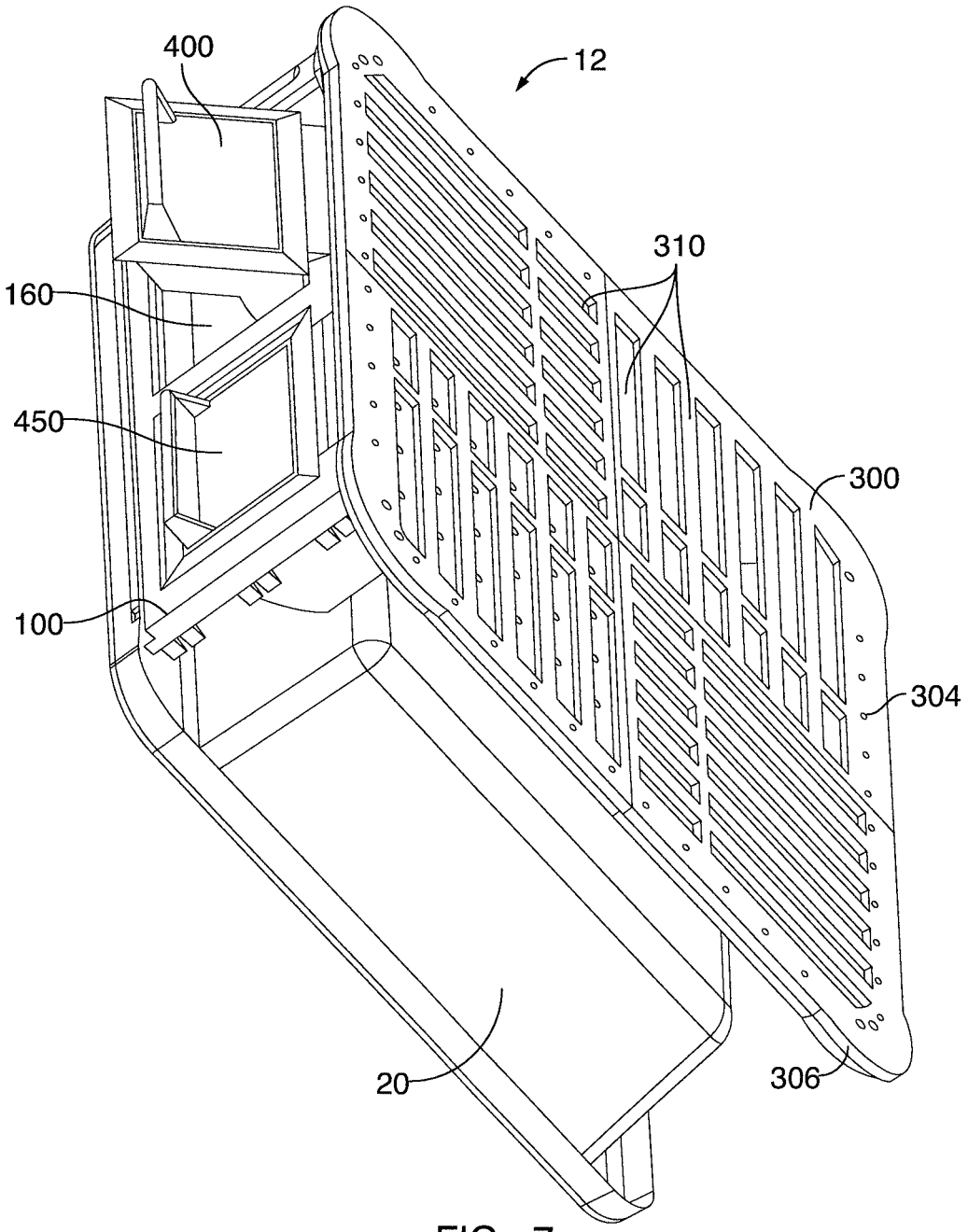
FIG. 7 is a perspective view of the sub-frameless support structure of FIG. 6, showing the bottom thereof.
Figure 8:
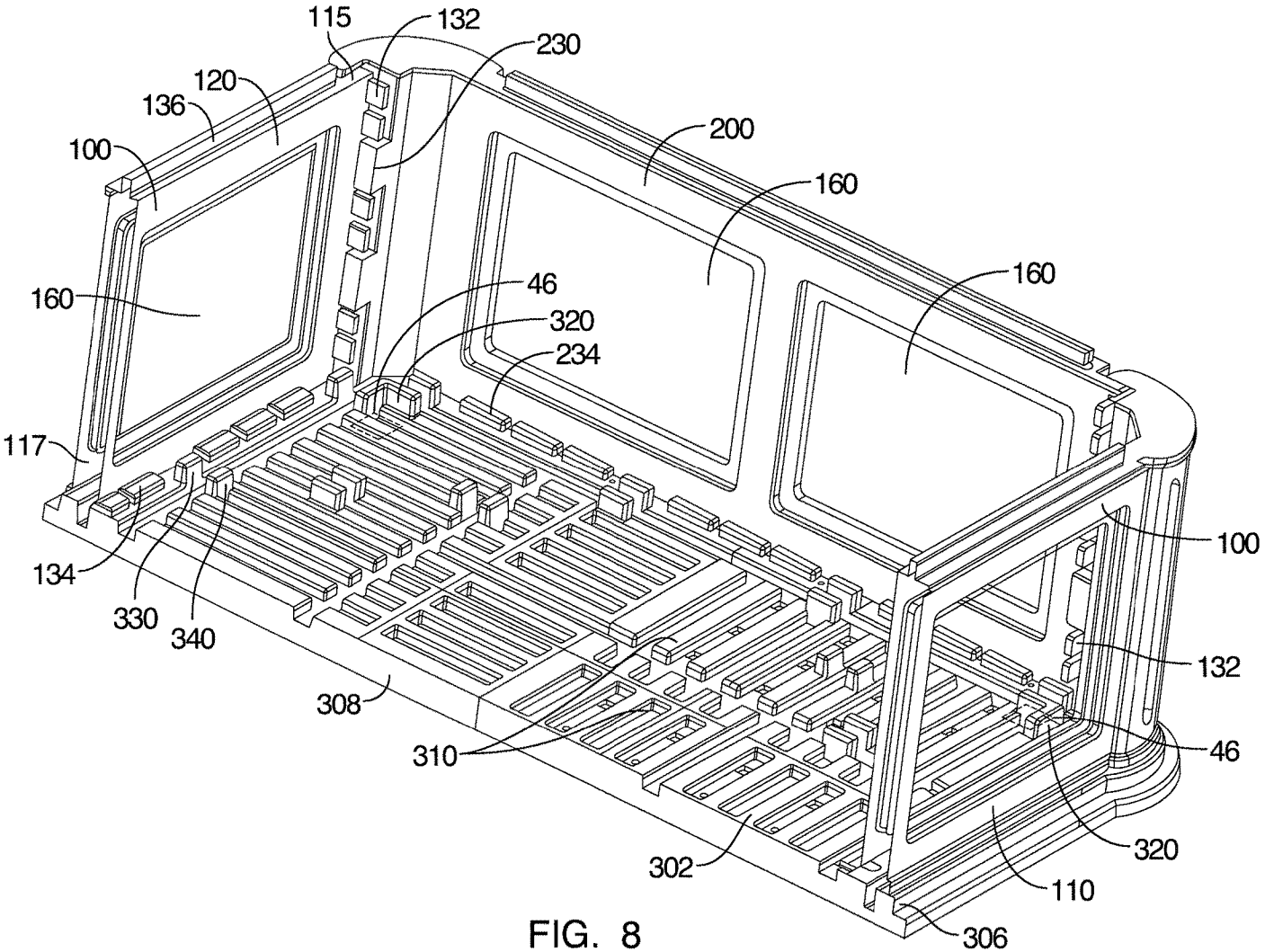
FIG. 8 is a perspective view of an interconnected end member and side member, shown partly in cross-section, of the sub-frameless support structure of FIG. 6.

As best shown in FIGS. 6-8, the spa cabinet 12 generally defines the support structure of the spa 10 and includes a pair of end members 100, a pair of side members 200, and a base member 300. The spa cabinet 12 may generally take the form of sub-frameless spa cabinet disclosed in U.S. Pat. No. 7,784,120 to Spicer, which is incorporated by reference herein in its entirety. A spa shell 20 which is preferably formed of acrylic but may be formed of any suitable plastic material or other impermeable material is fully supported by the end members 100, side members 200 and base member 300. The spa shell 20 is designed to hold water for use of the spa. As best shown in FIGS. 1-3 and 6, the spa shell has a plurality of through-holes 22 that are sized and shaped to accept the lifter arms 18 therethrough.

With further reference to FIG. 3, the lifter arms 18 are telescoping, generally hollow members that house actuation members 24 which support the cover 16 and employ a lifting means, such as a rack and pinion system or a tension member and rotatable guides, powered by a motor, as is known in the art. As shown therein, the cover assembly 14, therefore, includes a lifter mechanism motor 26 having output shafts that are connected to drive shafts 28. The drive shafts 28 are located in recessed spaces 30 in the base member 300 and drive the actuation members 24 within the lifter arms 18, as discussed in detail below.

Figure 9:
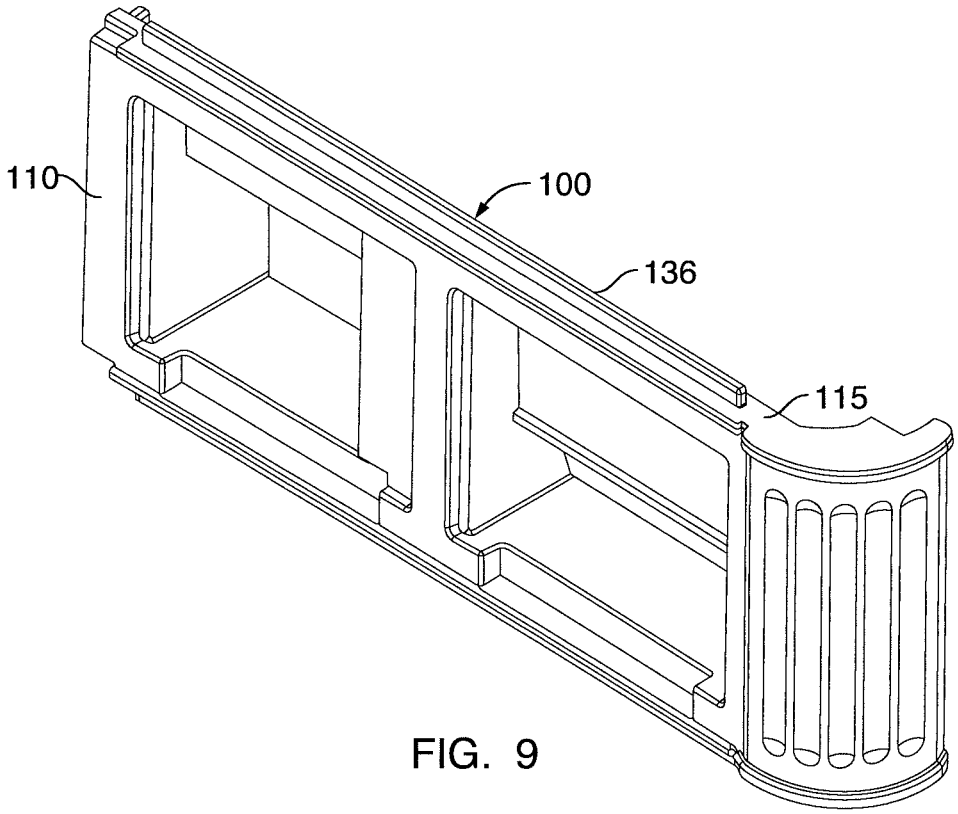
FIG. 9 is a perspective view of an outside wall portion of a side member of the support structure.
Figure 10:
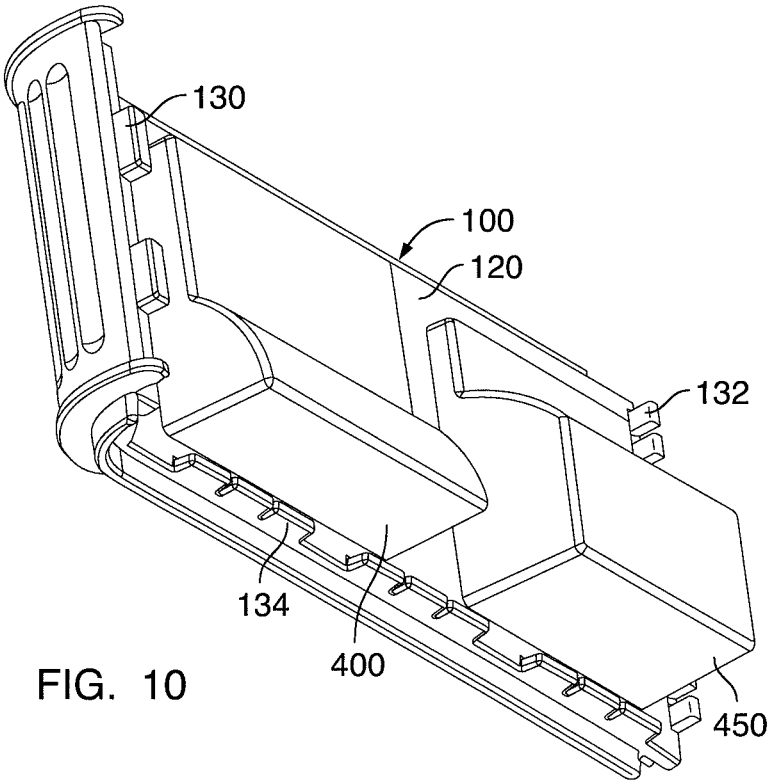
FIG. 10 is a perspective view of an inside wall portion of a side member of the support structure.

Referring to FIG. 6-10, the particular construction of the spa cabinet 12 is shown. As best shown in FIGS. 9 and 10, an end member 100 is shown. End member 100 has an outside wall 110, an inside wall 120, and a perimeter wall portion 115 that fully encloses an air pocket 117. End member 100 has an outer surface formed in the shape of a decorative column 150, although it will be obvious to those of skill in the art that any type or kind of decorative element may be molded or otherwise formed into the outer surface of the end members 100 and side members 200. A series of tabs 300, 302, 304 and 306 are utilized to aid in interconnecting end members 100 with side members 200, base member 300, and spa shell 14. An opening 160 is provided to allow for the placement of a removable insulated door to provide a means of access to the inside of the spa cabinet.

Alternatively, opening 160 may be utilized to receive an accessory device. It is envisioned that an accessory device may take the form of a towel warming container in the form of container 400, as shown in FIG. 11, or a set of steps 450, as shown in FIG. 12.

Figure 11:
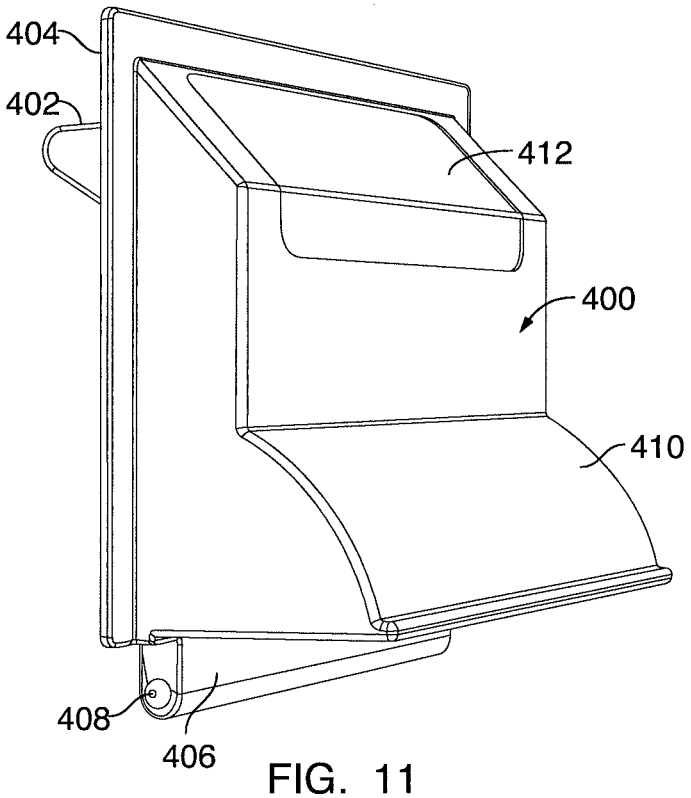
FIG. 11 is a perspective view of a towel-warming accessory.

As best shown in FIG. 11, the towel warming accessory 400 includes a handle 402, a face plate 404 having an outer flat surface, a mounting flange 406, a pivotal connection 408, a container portion 410 that receives towels, and a door member 412 to provide access to the interior of the container 410.

Figure 12:
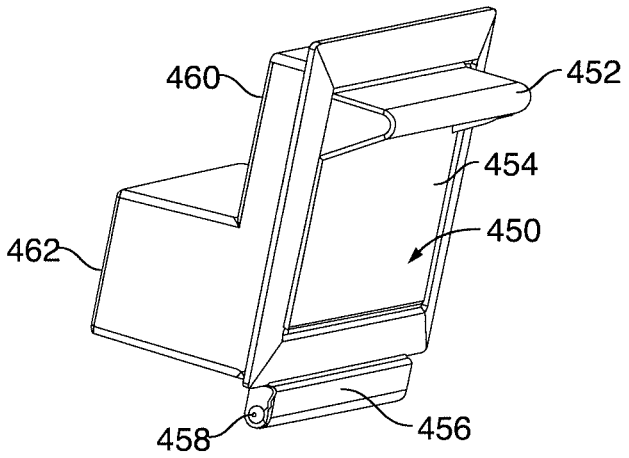
FIG. 12 is a perspective view of an accessory device in the form of a set of steps.

As best shown in FIG. 12, the set of steps 450 includes a handle 452, a face plate 454 having an outer flat surface, a mounting flange 456, a pivotal mounting device 458, and a pair of steps 460 and 462. Once the handle 452 is pulled downwardly, the steps 460 and 462 will be placed in a horizontal position allowing a user to step on said steps 460 and 462 to gain access to the interior of the spa shell 14. The accessory devices are preferably pivotally attached to the end members 100 of the spa cabinet 12, although other mean of attachment known the art are also possible. In a open position, the respective accessory devices 400, 450 extend outward of a side member 200 (or end member 100) in which they are mounted. Moreover, while in a closed position, the accessory devices 400, 450 are located completely inside the spa walls and do not impede or interfere with lawn maintenance or other activities around the perimeter of the spa.

In an embodiment, the length of the side members 200 may be identical to the length of the end members 100, in which case the spa is square in shape. In another embodiment, the side members 200 are longer than end members 100 in which case the spa is rectangular in shape. Other variations can be made to accommodate any shaped spa desired by the provision of additional pieces with different angles of interconnection. In the figures, the end member and side member components have the same corresponding last two digits, but side member components are prefaced by the number 200 rather than the number 100, which is utilized for an end member component. For example, tabs 130 and 134 on end member 100 are identified to tabs 230 and 234 on side member 200.

With further reference to FIGS. 6 and 7, base member 300 has an upper wall portion 302 and a lower wall portion 304, each of which are provided with a waffled pattern 310 of corrugations to add strength to such wall portions. A perimeter wall portion 306 interconnects the upper wall portion 302 and the lower wall portion 304 enclosing a pocket of insulating space 308 between said walls. The pocket of insulating space 308 may be fully enclosed (as shown) or may be left partially open to allow air to flow into and out of said pocket. Further, it will be obvious that said pocket of insulating space may be filled with air or alternatively with an insulating foam material or any other insulating material to provide insulation from sound and temperature. The upper wall portion 302 of the base member 300 is formed to have upwardly extending L-shaped corner posts 320 that, in combination with upwardly extending inner posts 340 and outer posts 330, aid in positioning and supporting the end members 100 and side members 200 onto the base member 300. As shown, end members 100, side members 200, and base member 300 are all formed of plastic and each include a fully enclosed air pocket which provides insulation from sound and temperature. While an air pocket is presently preferred, some manufactures, or users may prefer the pockets of insulating space to be filled with an insulating foam material. Such a foam material may provide superior insulating properties and may add to the overall strength of the structure, but will add some additional weight to the spa.

The lifting mechanism for raising and lowering the cover 16, i.e., the actuation members 30, may be any type of lifting mechanism known in the art. For example, in an embodiment, the actuation members 30 are a rack and pinion assisted by a cable and pulley, as disclosed in U.S. Pat. No. 7,614,093, which is hereby incorporated by reference in its entirety. In another embodiment, the actuation members 30 may be a chain and a plurality of sprockets assisted by a cable and pulley, as also disclose in U.S. Pat. No. 7,614,093. As noted above, regardless of the particular type of actuation members utilized to vertically move the cover 16 between a raised position and a lowered position, the actuation members 30 may be housed within telescoping lifter arms 18 so as to esthetically cover the actuation members 30.

Optionally, a biasing means, such as a hydraulic cylinder, may be utilized to assist the actuation members 30 to reduce load of the full weight of the cover 18 on the motor 24.

Turning once again to FIGS. 1-4, the cover 16 is of a generally pyramidal-shape and has a foam core surrounded by a substantially rigid plastic outer shell. As will be readily appreciated, this shape is particularly advantageous for deck-integrated spas (where the top of the spa is generally level with the top surface of a deck) to prevent persons or animals from walking or lying on the cover 16 and to minimize the amount of snow, ice and other debris buildup on the cover 16.

As best shown in FIG. 3, the cover 16 has a top wall 32 and an inner wall 34. The top and inner walls 32, 34 are constructed from a plastic with an insulation 36 therebetween. As shown therein, the inner wall 34 has a cross-sectional profile that is complimentary to, but different from the top wall 32. As best shown in FIG. 4, the top wall 32 is divided into quadrants 36 and has multiple surfaces that are angled with respect to each other. In particular, each quadrant 36 has a trough 38 that is sloped downward from a top center of the cover to an outer edge, and has angled surfaces that are sloped inward toward the trough 38. As will be readily appreciated, the particular shape and configuration and of the top wall 32, including the trough 38, functions to clear snow, debris, and water from the cover 16.

The inner wall 34 has a mating spa shell portion 40 that is shaped to substantially mate with a portion of an upper surface of the spa shell 20. In operation, in the lowered position, the cover 16 forms a seal with a top surface of the spa shell 20 and with the upper surface of the spa support structure/cabinet 12. In an embodiment, a deformable seal element may be positioned along an inner periphery of the cover 16 that mates with either the spa shell 20 or a top surface of the cabinet 12. In an embodiment, the cover has an outer lip that is sized and shaped to rest against the cabinet 12 to form a seal therebetween, and which is stepped or otherwise complimentary in shape to the outer edge of the spa shell 20 to form a seal therebetween.

The inner wall 34 may include a domed recess 42 over the recessed portion of the spa shell 20. In an embodiment, a light source is affixed within the cover 16 and is located along the domed surface 42 of the cover 16 to provide light to occupants of the spa 10. It is envisioned that the light source may be located anywhere along the cover.

At each corner of the cover 16, a recess 44 extends upward into the cover and is sized and shaped to accept a top portion of the telescoping lifter arms 18. It is envisioned that the lifter arms 18 and actuating members 30 be connected to the cover 16 with a permanent fastening means or by a removable fastening means. In another embodiment, the cover 16 rests on, but is not positively fastened to, the lifter arms 18 or actuating members 30.

In an embodiment, the cover 16 may include a removably attached safety section that has an interference fit with the cover 16. In an embodiment, one of the quadrants 36 or a portion thereof may be removable to provide access to the interior of the spa 10.

Importantly, the base 300 includes moulded impressions 46 at the corners thereof, as best shown in FIG. 8, that are configured to receive the ends of the actuation members 30 and lifter arms 18. As will be readily appreciated, the moulded impressions 46 in the base 300 serve to locate and retain the actuation members 30. In addition, the actuation members 30 are directly fastened to either an end member 100 or a side member 200 using brackets or the like. This is in stark contrast to existing vertically movable covers which require a wood sub-frame to support the lifting mechanism. By locating the actuating members 30 within the impressions 46, and by fastening them directly to the side members 100 or end members 200 of the spa cabinet 12, structural strength and rigidity of both the cover assembly 14 and the spa cabinet 12, is increased.

In addition, the fact that the actuation members 30 and lifter arms 18 extend through the spa shell 20 via complimentary shaped through-holes 22 provides increased structural strength, rigidity and support to the cover assembly 14, as a whole. In particular, the cover assembly 14 is affixed to the cabinet 12 and supported by at least three points of contact with the spa: (1) contact with the base 300 of the cabinet 12 via the impressions 46, (2) contact with either the end members 100 or side members 200 of the cabinet 12 via direct fastening (e.g., through a connecting bracket), and (3) contact with the rigid spa shell 20 through through-holes 22. Importantly, these three points of contact obviate the need to provide a separate sub-frame to support the cover assembly 14, including the associated lifting mechanism. Moreover, the fact that these three points of support occur at different heights (i.e., from the base member 300 to the top surface of the spa shell 20), provides for increased structural strength and sturdiness of the cover assembly 14 as compared to existing cover assemblies that utilize points of fixation below the top surface of the spa shell.

Figure 13:
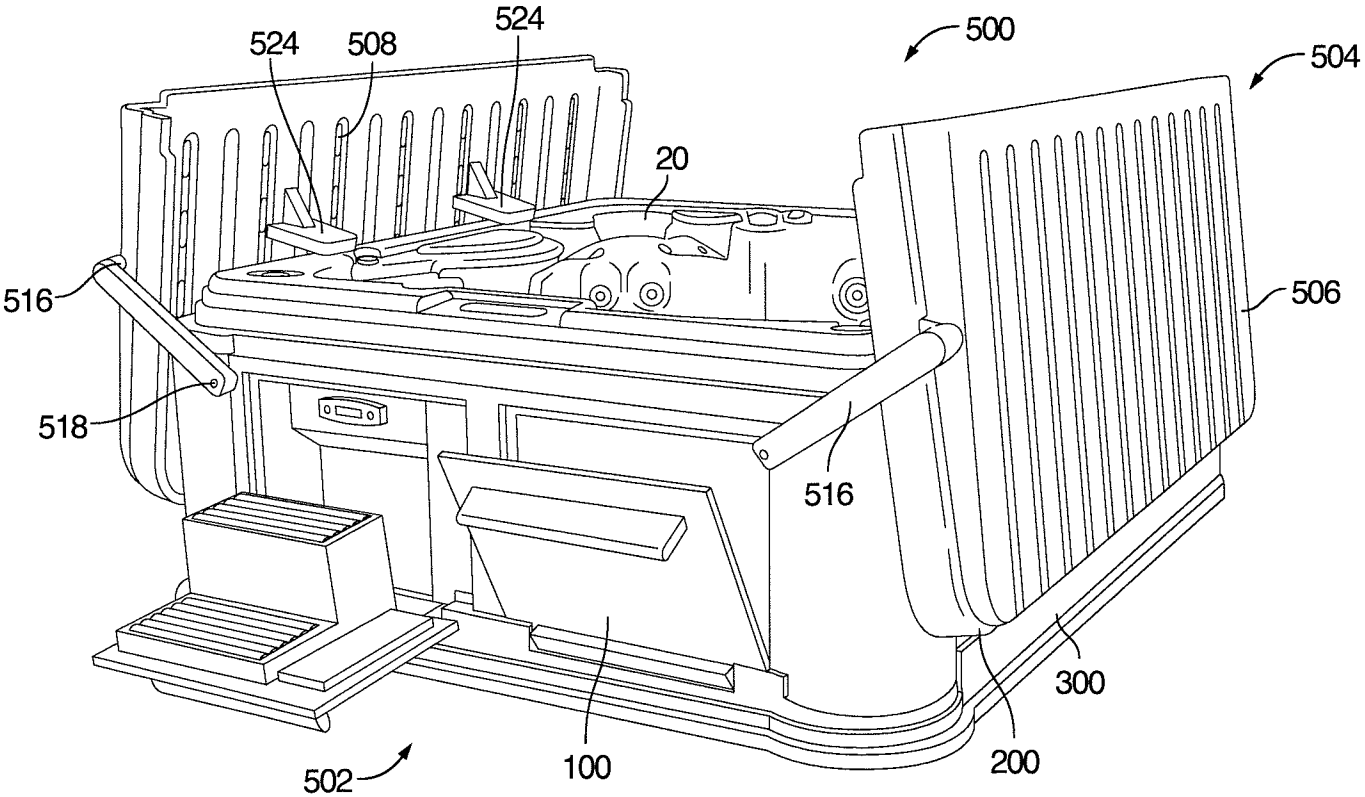
FIG. 13 is a perspective view of a spa having a retractable cover, in accordance with an alternative embodiment of the present invention.
Figure 14:
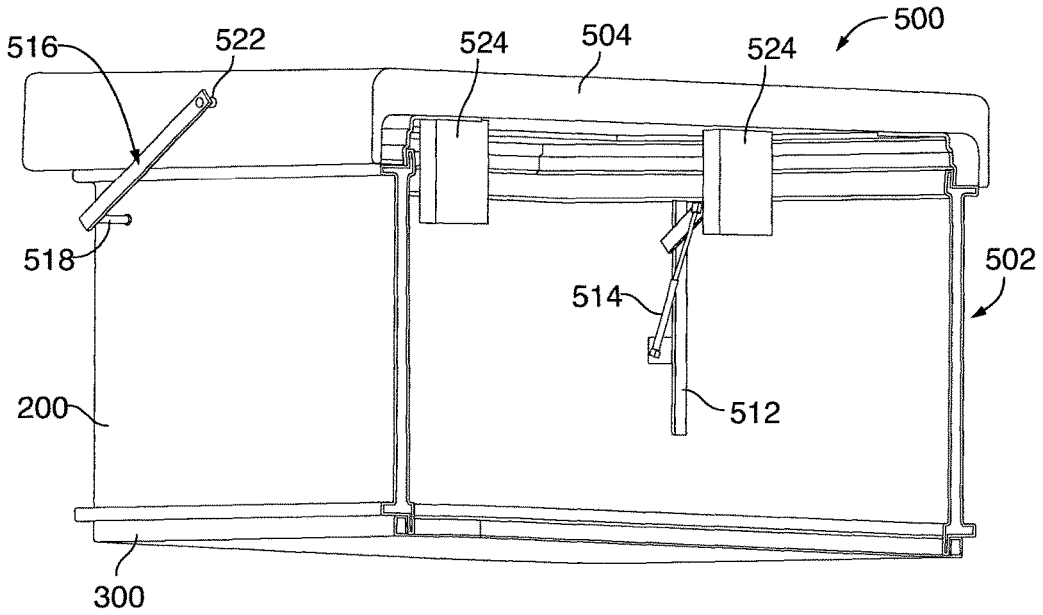
FIG. 14 is a cross-sectional, perspective view of the spa of FIG. 13, illustrating the cover in a covered position.
Figure 15:
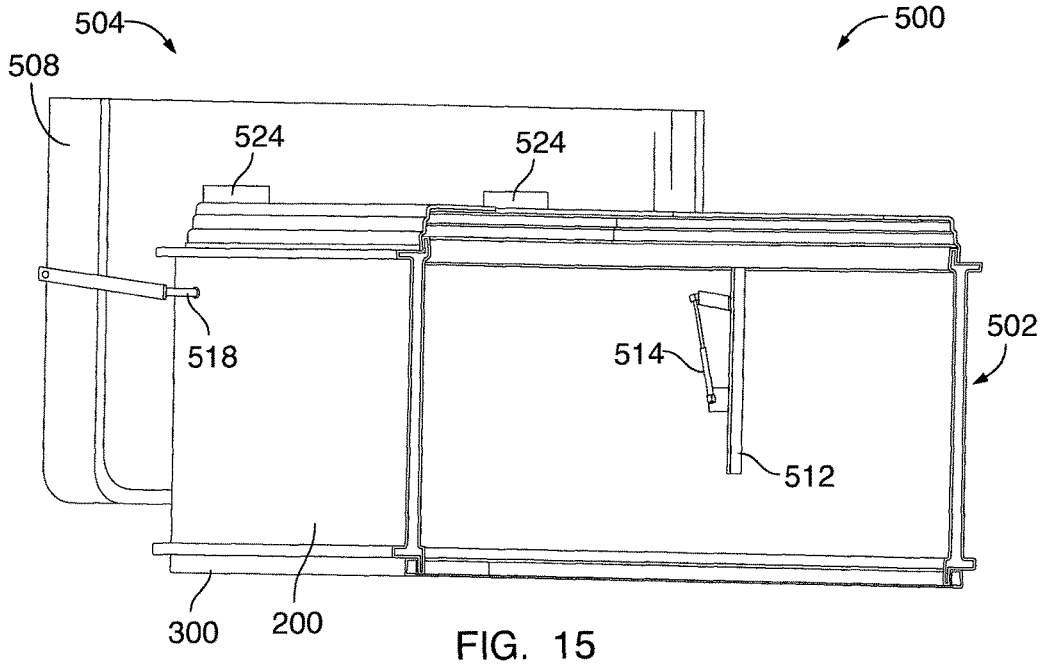
FIG. 15 is a cross-sectional, perspective view of the spa of FIG. 13, illustrating the cover in a retracted position.

FIGS. 13-15 illustrate a spa having a removable cover assembly 500 according to an alternative embodiment of the present invention. As shown therein, the spa 500 includes a spa cabinet 502 and a cover assembly 504. The spa cabinet is generally the same as the spa cabinet 12 and defines the support structure of the spa. In particular, the cabinet 502 is a sub-frameless spa and includes a pair of end members 100, a pair of side members 200, and a base member 300. In addition, like the spa 500 described above, spa 500 includes a spa shell 20 which is preferably formed of acrylic, but may be formed of any suitable plastic material or other impermeable material, and which is fully supported by the end members 100, side members 200 and base member 300. The spa shell 20 is designed to hold water for use of the spa 500.

Figure 16:
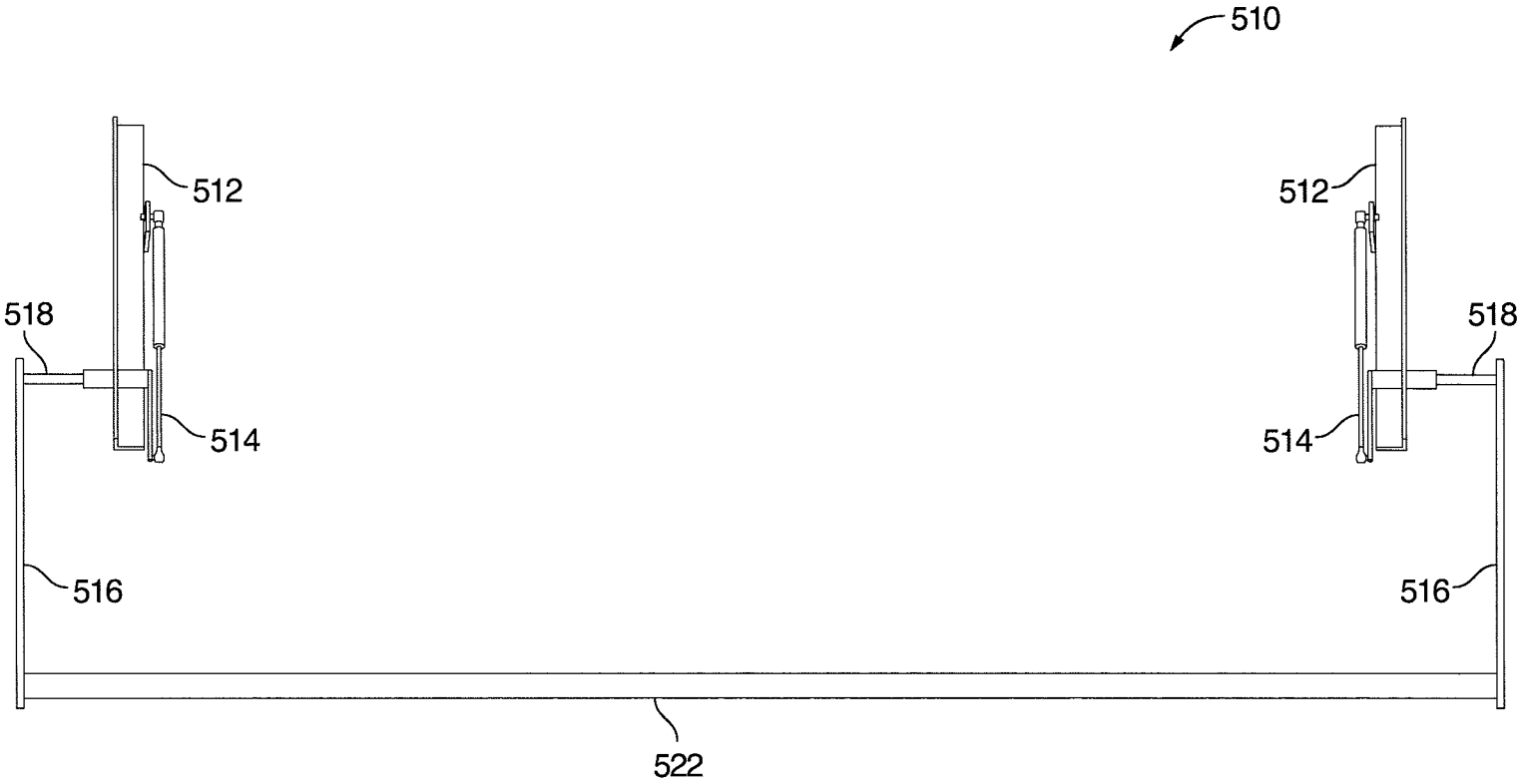
FIG. 16 is a perspective view of a mounting mechanism of the retractable cover.
Figure 17:
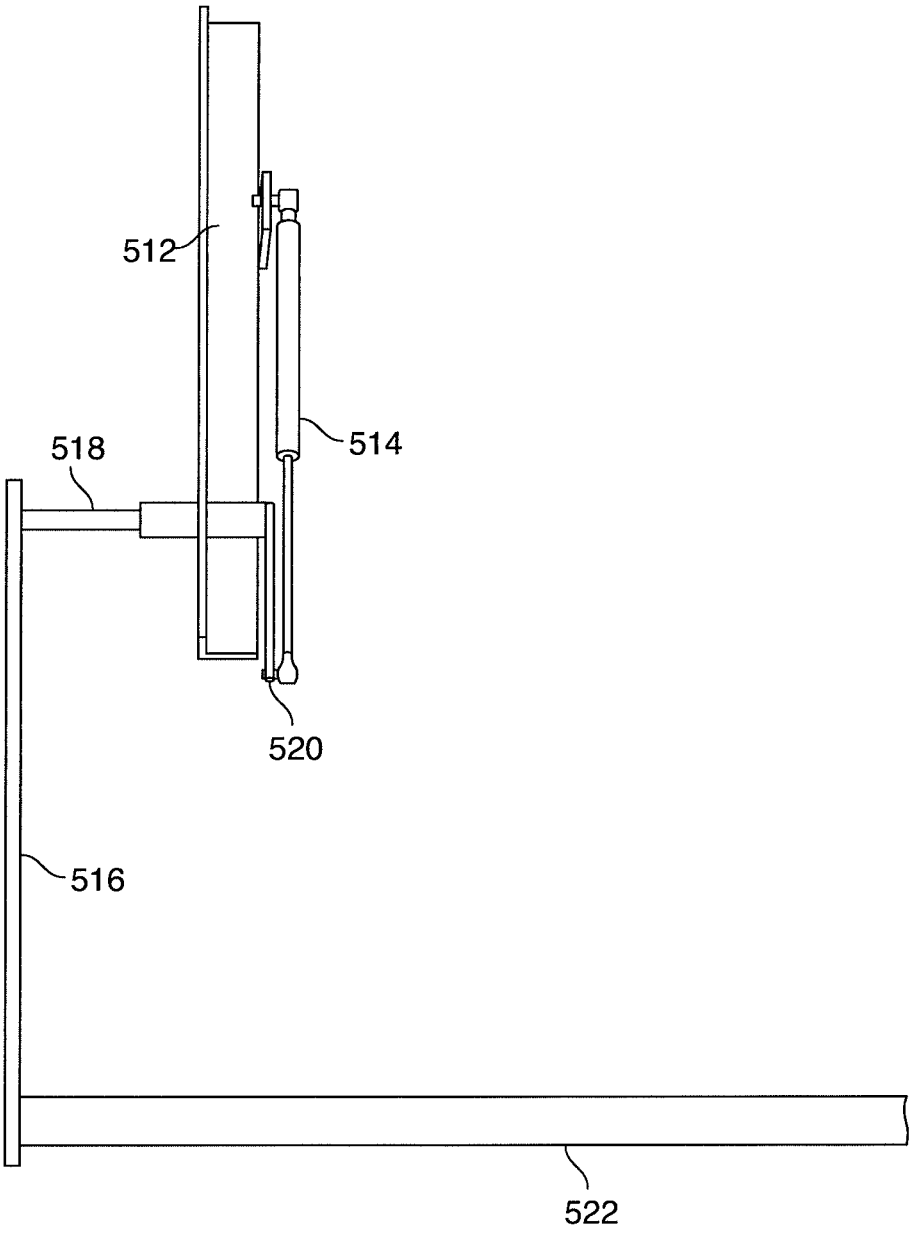
FIG. 17 is an enlarged view of the mounting mechanism of FIG. 16.

As shown therein, the cover assembly 504 includes a first cover member 506 and a second cover member 508. Each cover member 506, 508 is pivotally attached to the spa cabinet 502 and is movable between a closed position, in which the cover member 506, 508 rests atop the cabinet 12 and shell 20, and an open position, in while the cover member 506, 508 rests adjacent to the sides of the spa 500 to permit access to the spa 500. In particular, each cover member 506, 508 is pivotally connected to the spa cabinet 12 via a mounting mechanism 510. The mounting mechanism 510 is best shown in FIGS. 16 and 17.

As shown therein, the mounting mechanism 510 is generally U-shaped and includes a pair of opposed mounting brackets 512, a pair of gas springs or shocks 514, and a pair of lifting arms 516 connected to the mounting brackets via a rotating guide 518. A pivot arm 520 is connected at one end to an end of the rotating guide 518 opposite the lifting arm 516, and at the other end to the gas spring 514. A tie bar 522 is connected to a distal end of the lifting arms 516 and extends therebetween.

As best shown in FIG. 14, the mounting brackets 512 are attached to the interior sidewalls of the cabinet 12 of the spa 5000 by screws, although other means of attachment known in the art may also be utilized without departing from the broader aspects of the present invention. The rotating guides 518 extends through apertures in the sidewalls such that the lifting arms 516 are positioned outside of the cabinet 12. The tie bar 522 extends through the respective cover members 506, 508 at generally a midpoint thereof, as shown in FIGS. 13 and 14.

Importantly, the cover members 506, 508 may rotate or pivot about an axis defined by the tie bar 522. In addition, the cover members 506, 508 (and the lifting arms 516) may rotate about an axis defined by the rotating guide 518. In this respect, the cover members 506, 508 each have two points of rotation (i.e., at opposing ends of the lifting arms 516). In operation, the cover members 506, 508 pivot about these two points so that a user can move the cover member 506, 508 between an open position and a closed position. As best shown in FIG. 14, in the closed position, the gas springs 514 are compressed such that they exert a generally upwards biasing force on the cover members 506, 508. As will be readily appreciated this biasing force is not enough to lift cover members 506, 508 from their engagement with the top of the cabinet 12 and/or spa shell 20. When a user moves the cover members 506, 508 from the closed position to an open position, the upwards biasing force exerted by the gas springs 514 assists the user in doing so, effectively decreasing the amount of effort required to retract the cover members 506, 508.

In particular, the assist mechanism of the gas springs 514 provides mechanical assisting forces for lifting and rotating one half of the cover assembly 504 (e.g., first cover member 504 or second member 506) onto the side of the spa cabinet 12 from a closed position to the open position. The assist mechanism also provides a closing force to maintain the half of the cover assembly 504 (e.g., first cover member 504 or second member 506) in a closed position. The gas spring 514 and the pivot arm 520 are aligned in an over center cam locking position when the cover member 504, 506 is in a closed position. As a result, a downward force is applied to the cover member 504, 506 acting through the lifting arms 516 and tie bar 522 in the closed position.

In addition, rotating one of the cover member 506, 508 up and to the side of the cabinet 12 un-aligns the gas spring 514 with the pivot arm 520 and allows the gas spring 514 to provide the mechanical assisting forces to the pivot arm 520, which compels both the pivot arm 520 and the lifting arm 516 to rotate with respect to the mounting bracket 514. As the lifting arm 516 rotates, the tie bar 522 is lifted up and to the side of the cabinet 12.

As best shown in FIGS. 13 and 14, each cover member 506, 508 includes a pair of stops 524 that extend from a bottom thereof. When the cover members 506, 508 are moved to their respective open positions, the stops 524 contact the top surface of the shell 20 or the top surface of the cabinet 12, thereby limiting downwards travel of the cover members 506, 508 and retaining them in a desired retracted position, as shown in FIG. 13.

As also shown in FIG. 13, the cover members 506, 508 include overlapping or interlocking structures that form a seal therebetween when in the closed position. In an embodiment, each member 506, 508 of the cover 504 is formed from a hard plastic shell with a hollow interior cavity. In an embodiment, the interior cavity may be filled with foam or other insulating material to aid in water heat retention.

Importantly, the retractable cover assembly of the present invention is easy to open and tucks down out of the way of users of the spa 500, thereby saving space.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A spa, comprising:

a base;

a shell supported by said base;

a retractable cover assembly including at least a first cover member pivotally secured to said base and moveable between a closed position in which said first cover member is atop said shell in generally horizontal arrangement, and an open position in which said first cover member is adjacent to a side of said base in generally vertical arrangement, said cover assembly further including a lift assembly for moving said first cover member between said open position and said closed position;

wherein said lift assembly includes a lifting arm having a first end pivotally connected to said first cover member and a second end pivotally connected to said base, the connection of said second end of said lifting arm with said base defining a pivot point, the lift assembly further including a lift-assist device having a first end coupled to said base at a point below said pivot point and a second end operatively connected to said lifting arm;

wherein in said closed position said lift-assist device is compressed such that it exerts a biasing force on said first cover member in a direction generally upwards to provide an assisting force for an uncovering operation; and wherein in at least one position of said first cover member between said closed position and said open position, said biasing force of said lift-assist extends in a direction through said pivot point.

2. The spa of claim 1, wherein:

said lifting arm is a substantially rigid member of fixed length.

3. The spa of claim 1, wherein:

said lifting arm and said lift-assist device are coupled to a different side of said base than the side to which the cover is positioned adjacent to in said open position.

4. The spa of claim 3, wherein:

said lift-assist device is a gas spring.

5. The spa of claim 4, wherein:

said lift-assist device is positioned interior to said base.

6. The spa of claim 3, wherein:

said second end of said lift-assist device does not extend above a top lip of said shell at any point during movement of said cover between said closed position and said open position.

7. The spa of claim 1, wherein:

said lift-assist device is configured to transmit a biasing force substantially along an axis defined by a longitudinal extent of said lifting arm at least at one position between said open and said closed position.

8. The spa of claim 1, further comprising:

a second cover member; and a second said lift assembly having a second lifting arm and a second lift-assist device, said second lift assembly being configured to exert a generally upwards biasing force on said second cover member when said second cover member is received atop said shell.

9. A lift assembly for a spa cover, comprising:

a lifting arm having a first end pivotally connectable to said spa cover and a second end pivotally connectable to a base of a spa, the connection of said second end of said lifting arm with said spa base defining a pivot point; and a lift-assist device having a first end configured for coupling to said base at a point below said pivot point and a second end operatively connectable to said lifting arm;

wherein when said cover is received atop said spa in a covered position said lift-assist device is compressed such that it exerts a force on said cover in a direction generally upwards to provide an assisting force for an uncovering operation; and wherein at an intermediate position between said covered position where said cover is received atop said spa and an uncovered position where said cover is positioned in generally vertical arrangement adjacent to a side of said base, said force exerted by said lift-assist device extends in a direction through said pivot point.

10. The lift assembly of claim 9, wherein:

said lift-assist device is a gas spring.

11. The lift assembly of claim 10, wherein:

said lifting arm is a substantially rigid member of fixed length.

12. The lift assembly of claim 10, wherein:

said lifting arm and said gas spring are coupled to a different side of said base than a side of said spa to which the cover is positioned when in said uncovered position.

13. The lift assembly of claim 10, said gas spring is configured for positioning interior to said base.

14. The lift assembly of claim 10, wherein:

said second end of said lift-assist device does not extend above a top lip of said shell at any point during movement of said cover between said covered position and said uncovered position.

15. The lift assembly of claim 14, wherein:

said lift-assist device is configured to transmit a biasing force substantially along an axis defined by a longitudinal extent of said lifting arm at least at one position between said open and said closed position.

* * * * *